US006444634B1

(12) United States Patent
Mason et al.

(10) Patent No.: US 6,444,634 B1
(45) Date of Patent: Sep. 3, 2002

(54) BLEACHING COMPOSITIONS

(75) Inventors: Susan Judith Mason, Whitley Bay; Ludivine Pascale Grippay; Nour-Eddine Guedira, both of Newcastle upon Tyne, all of (GB); Donald Ray Brown, Middletown; Michelle Frances Mellea, Hamilton, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/508,442

(22) PCT Filed: Jun. 12, 1998

(86) PCT No.: PCT/US98/12325

§ 371 (c)(1),
(2), (4) Date: Mar. 9, 2000

(87) PCT Pub. No.: WO99/13037

PCT Pub. Date: Mar. 18, 1999

(30) Foreign Application Priority Data

Sep. 11, 1997 (GB) ..... 9719231
Sep. 11, 1997 (GB) ..... 9719235

(51) Int. Cl.[7] ..... C11D 3/00; C11D 3/48; C11D 7/18; C11D 7/54; C11D 17/00

(52) U.S. Cl. ..... 510/376; 510/382; 510/444

(58) Field of Search ..... 510/444, 376, 510/382

(56) References Cited

U.S. PATENT DOCUMENTS 4,927,559 A 5/1990 Schwarz ..... 252/186.39

FOREIGN PATENT DOCUMENTS

| | | | |
|---|---|---|---|
| DE | 44 43 177 A1 | | 6/1996 |
| DE | 196 16 782 A1 | | 10/1997 |
| EP | 0 257 700 A2 | | 3/1988 |
| JP | 7-238298 | * | 9/1995 |
| JP | 07 238298 | | 9/1995 |
| WO | WO 94/28103 | * | 12/1994 |
| WO | WO 95/27775 | | 10/1995 |

* cited by examiner

*Primary Examiner*—Yogendra N. Gupta
*Assistant Examiner*—John M Petruncio
(74) *Attorney, Agent, or Firm*—Marianne Dressman; Julia A. Glazer; Kim William Zerby

(57) ABSTRACT

Granular detergent compositions and in particular low density, phosphate containing detergent compositions comprise a specific bleaching system containing hydrophobic peracid bleach and hydrophilic peracid bleach and a peroxide source. These detergent compositions have specific low levels of available oxygen from hydrophobic aid hydrophilic peroxyacid bleach, specific ratios of available oxygen from the hydrophobic peracid bleach to the hydrophilic peracid bleach and specific ratios of available oxygen of the peroxide source to the available oxygen of the peracids. These specific mixed bleach systems are useful for sanitization or reduction of bacterial activity.

10 Claims, No Drawings

BLEACHING COMPOSITIONS

TECHNICAL FIELD

The present invention relates to bleach-containing compositions, suitable for use in laundry washing methods.

BACKGROUND TO THE INVENTION

In the past decades research efforts have been directed towards the development of bleaching systems, based on organic peroxyacids, which can provide effective stain and/or soil removal from fabrics at lower wash temperatures. The organic peroxyacids are often obtained by the in situ perhydrolysis of organic peroxyacid bleach precursor compounds (bleach activators).

A commonly employed precursor compound is tetraacetyl ethylene diamine (TAED) which provides effective hydrophilic cleaning especially on beverage stains. To achieve effective bleaching of a detergent, both hydrophobic and hydrophilic stains need to be bleached by the bleach system. Further organic peroxyacid precursors have thus been developed to deal with hydrophobic stains and soils.

Various documents disclose the use of mixtures of hydrophobic and hydrophilic bleaches in detergents, for example JP 7-238298 DE 196,16, 782, WO94/28103.

However, the inventors have found that most prior art bleaching compositions do not always perform satisfactory when used under stressed conditions, such as low temperature washing, washing with limited agitation, use of low quantities of detergent actives, highly soiled fabrics, presence of high levels of metal ions, or after storage under humid or high temperature. These problems occur in particular in low density detergents, in particular when the overall level of the bleach system in the detergent composition is low, and also in detergents which contain high levels of phosphate-builder, which may introduce metal ions to the wash.

Furthermore, to achieve an efficient bleach system, the system should provide excellent bleaching at low levels, thereby minimizing the chance of damage to the fabrics.

Thus, there is a need to provide detergent compositions which comprise low levels of a bleaching system, which has a very effective bleaching performance under stressed conditions, on both hydrophobic soils and hydrophilic soils.

The inventors have now surprisingly found that improved bleaching under stressed conditions can be achieved by use of a bleaching-composition containing a low level of bleach activators and peroxide source, namely having an available oxygen (AvO) derived from hydrophobic and hydrophilic bleach activators of less than 5000 ppm, and having a specific ratio of AvO of the hydrophobic activator to the AvO of the hydrophilic activator, namely from 3:1 to 1:50, and a specific ratio of the total AvO to the AvO of the activators, namely more than 2:1. The bleach system has been found to be particularly useful in low density detergents, in hand washing detergents, in phosphate-containing compositions, and also in washing processes where a low concentration of detergent is used.

In general, bleach and in particular hypochlorite bleach is known to kill bacteria. High levels of bleach are normally required to provide a sufficient reduction of the bacteria's or to eliminate the bacteria's. Therefore, most detergents which comprise bleach systems known in the art, which only comprise low levels of bleach, are not effective as biocide agents for sanitization.

The inventors have found that mixed bleach systems, comprising specific levels and ratios of hydrophobic, hydrophilic bleach additives and peroxide sources are very useful as biocide agents.

They have found that even the use of low levels of specific bleach compositions in wash solutions or in detergents or cleaning agents, provides effective sanitization of the washed fabrics or surfaces, or effective reduction of the bacterias when the bleaching components are used in the specific ratios, mentioned herein.

All documents cited in the present description are, in relevant part, incorporated herein by reference.

SUMMARY OF THE INVENTION

The present invention relates to a detergent composition, having a density from 330 g/liter to 700 g/liter, comprising a bleaching system containing a hydrophilic and a hydrophobic peracid bleach or peracid bleach presursor and a peroxide source, characterized in that the total level of Available Oxygen from the hydrophilic and hydrophobic peracid bleach or bleach precursors (AvO-a) is less than 5000 ppm, the ratio of Available Oxygen of the hydrophobic peracid or precursor (AvO-hb) to the Available Oxygen of the hydrophilic peracid or precursor (AvO-hp) is from 3:1 to 1:50 and the ratio of the Available Oxygen of the peroxide source (AvO-o) to the AvO-a is at least 2:1.

DETAILED DESCRIPTION OF THE INVENTION

In the detergent compositions of the invention, the total level of Available Oxygen from the hydrophilic and hydrophobic peracid bleach or bleach precursors (AvO-a) is less than 5000 ppm, or even less than 4000 ppm or even less than 3000 ppm or even less than 2500 ppm.

The ratio of Available Oxygen of the hydrophobic peracid or precursor (AvO-hb) to the Available Oxygen of the hydrophilic peracid or precursor (AvO-hp) is from 3:1 to 1:50, more preferably from 2.5:1 to 1:30, or even 2:1 to 1:20.

The ratio of the Available Oxygen of the peroxide source (AvO-o) to the AvO-a is at least 2:1, preferably at least 3:1 or even 4:1.

The compositions preferably have a density from 370 g/liter to 700 g/liter, or even to 650 g/liter or even to 600 g/liter.

It may be preferred that the composition is a low density granular composition, in particular phosphate-containing compositions and in particular high sudsing compositions, soaking or pre-treatment compositions, hand washing compositions.

Thus, the invention also relates to a method of washing laundry by hand or pre-treating or soaking of laundry, whereby a detergent composition according to the invention.

The invention also relates to the use of bleaching compositions, comprising hydrophobic and hydrophilic peracid bleach or precursors thereto, and a peroxide source for reduction of the activity of bacteria, whereby the ratio of AvO-hb to AvO-hp is from 3:1 to 1:50, preferably 2.5:1 to 1:10 as even 2:1 to 1:20 and whereby the ratio of AvO-o to AvO-a is at least 2:1, preferably at least 3:1 or even 4:1.

When used herein, "reduction of the activity of bacteria" includes killing of the bacteria or part thereof and inhibition of further growth or development of bacteria.

Preferably the bleaching compositions are used for sanitisation of the fabrics or surfaces, cleaning with the bleaching compositions. Then, it is preferred that the sanitization method involves contacting the fabrics or surfaces containing bacteria's, in particularly present in stain on the fabrics or surfaces, with the compositions. Thus, the invention also encompasses a method for sanitisation of fabrics whereby the fabrics are contacted with a composition or a solution of a composition, comprising a hydrophilic and hydrophobic peracid bleach or precursors thereto and a peroxide source, characterized in that the ratio of Available Oxygen of the hydrophobic peracid or precursor (AvO-hb) to the Available Oxygen of the hydrophilic peracid or precursor (AvO-hp) is from 3:1 to 1:50 and the ratio of the Available Oxygen of the peroxide source (AvO-0) to the total level of Available Oxygen from the hydrophilic and hydrophobic peracid bleach (AvO-a) is at least 2:1.

The bleaching compositions are preferably present in cleaning compositions for cleaning fabrics or surfaces, preferably laundry or dishwashing detergents or hard-surface cleaners. Preferred are laundry detergent compositions for comprising the ingredients described herein.

Preferably the level of AvO-a in the cleaning compositions or detergent composition, or solutions thereof, which contain the bleaching composition and which are for use of reducing the activity of bacteria, is up to 10,000 ppm, more preferably, up to 5,000 ppm or even 4,000 ppm or even 3,000 ppm or 2,500 ppm.

Preferred hydrophilic and hydrophobic peracid bleaches or precursors thereto and preferred peroxide sources are described hereinafter.

Hydrophobic and Hydrophilic Peracids or Peracid Precursors

An essential feature of detergent compositions of the invention is a hydrophobic peracid or precursor thereto.

The bleaching system preferably comprising a hydrophobic percarboxylic acid and/ or precursor thereto, of the formula $$R^1—CO_3M$$

wherein $R^1$ has at least 6 carbon atoms, and M is a counterion; or of formula $$R^1—CO—L$$

wherein L is a leaving group which is linked to the $R^1$—CO— group with an oxygen atom, and $R^1$ has at least 6 carbon atoms. Preferred leaving groups are benzoic acid and derivatives thereof and especially benzene sulphonate.

Percarboxylic acid bleach precursor are compounds which react with hydrogen peroxide in a perhydrolysis reaction to produce a percarboxylic acid.

The counterion M of the percarboxylic acid is preferably sodium, potassium or hydrogen.

Preferably such hydrophobic peracids or precursors thereto are those whose parent carboxylic acid has a critical micelle concentration less than 0.5 moles/liter and wherein said critical micelle concentration is measured in aqueous solution at 20°–50° C.

The percarboxylic acid, preferably formed from the precursor, preferably contains at least 7 carbon atoms, or at least 8 or even 9 carbon atoms, and it may be preferred that it contains from 7 to 12 carbon atoms, more preferably from 8 to 11 carbon atoms, most preferably 9 or 10 carbon atoms. In a preferred aspect the percarboxylic acid formed from the precursor or the peroxy acid has an alkyl chain comprising at least 7 carbon atoms, more preferably at least 8 carbon atoms, most preferably 9 carbon atoms.

The percarboxylic acid precursor can be any ester which had been described as a bleach activator for use in laundry detergents, for instance alkyl percarboxylic acid precursors described herein, sugar esters, such as pentaacetylglucose, esters of imidic acids such as ethyl benzimidate triacylcyanurates, such as triacetylcyanurate and tribenzoylcyanurate an esters giving relatively surface active oxidising products for instance of $C_{8-18}$-alkanoic or-aralkanoic acids such as described in GB-A-864798, GB-A-1 147871 and the esters described in EP-A-98129 and EP-A-106634.

Preferred can be phenyl esters of $C_{14-22}$ -alkanoic or alkenoic acids, esters of hydroxylamine, geminal diesters of lower alkanoic acids and gem-idols, such as those described in EP-A-0125781 especially, 1,1,5-triacetoxypent-4-ene and 1,1,5,5-tetraacetoxypentane and the corresponding butene and butane compounds, ethylidene benzoate acetate and bis(ethylidene acetate) adipate and enol esters, for instance as described in EP-A-0140648 and EP-A-0092932.

Other highly preferred hydrophobic alkyl percarboxylic acid precursors include decanoly oxy benzoic acid or salt thereof, dodecanoyloxy-benzenesulphonate sodium or potassium salt, decanoyloxy-benzenesulphonate sodium or potassium salt (DOBS), benzoyloxy-benzenesulphonate sodium or potassium salt salt (BOBS), more preferred sodium or potassium 3,5,5-tri-methyl hexanoyloxybenzene sulfonate (iso-NOBS) and even more preferred sodium or potassium nonanoyloxybenzene sulfonate (NOBS).

Amide substituted bleach activator compounds may also be useful herein, such as those described in EP-A-0170386. Suitable examples of this class of agents include the precursors or the acids such as (6-hexylamino)-6-oxo-caproic acid(6-octylamino)-6-oxo-caproic acid, (6-nonylamino)-6-oxo-caproic acid, (6-decylamino)-6-oxo-caproic acid, magnesium monoperoxyphthalate hexahydrate, the salt of metachloro perbenzoic acid, 4-nonylamino-4-oxoperoxybutyric acid and diperoxydodecanedioic acid, or precursors thereof, in particlarly having a benzene sulphonate leaving group. Such bleaching agents are disclosed in U.S. Pat. No. 4,483,781, U.S. Pat. No. 4,634,551, EP 0,133, 354, U.S. Pat. No. 4,412,934 and EP 0,170,386.

Other suitable organic peroxyacids include diperoxyalkanedioc acids having more than 7 carbon atoms, such as diperoxydodecanedioc acid (DPDA), diperoxytetradecanedioc acid and diperoxyhexadecanedioc acid. Mono- and diperazelaic acid, mono- and diperbrassylic acid and N-phthaloylaminoperoxicaproic acid (PAP), nonanoylamido peroxo-adipic acid (NAPAA) and hexane sulphenoyl peroxypropionic acid and are also suitable herein.

The compositions also comprise hydrophilic peracids or precursors thereto, preferably of the formula $$R^1—CO_3M$$

wherein $R^1$ has at less than 6 carbon atoms, and M is a counterion; or of formula $$R^1—CO—L$$

wherein L is a leaving group which is linked to the $R^1$—CO— group with an oxygen atom, and $R^1$ has less then 6 carbon atoms.

A preferred hydrophilic precursor is TAED.

Peroxide Source

Inorganic perhydrate salts are a preferred source of peroxide. Preferably these salts are present at a level of from 0.01% to 30% by weight, more preferably of from 0.5% to 10%.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Additional Detergent Components

The detergent compositions in accord with the invention may also contain additional detergent components. The precise nature of these additional components, and levels of incorporation thereof will depend on the physical form of the composition or component, and the precise nature of the washing operation for which it is to be used.

The compositions of the invention preferably contain one or more additional detergent components selected from additional surfactants, additional bleaches, bleach catalysts, alkalinity systems, builders, phosphate-containing builders, organic polymeric compounds, enzymes, suds suppressors, lime soap, dispersants, soil suspension and anti-redeposition agents soil releasing agents, perfumes, brightners, photobleaching agents and additional corrosion inhibitors.

Bleach Catalyst

The bleach system can contain a transition metal containing bleach catalyst.

One suitable type of bleach catalyst is a catalyst system comprising a transition metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

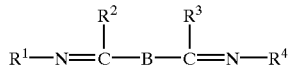

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof. Highly preferred may be manganese bridged cyclams, such as Mn dichloro cyclam or Mn 1,4,8,11 tetra azacyclotetradecane.

Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts). Highly preferred may be pentaamine cobalt (III) acetate dichloride salt.

The bleach catalyst is typically used in a catalytically effective amount in the compositions and processes herein. By "catalytically effective amount" is meant an amount which is sufficient, under whatever comparative test conditions are employed, to enhance bleaching and removal of the stain or stains of interest from the target substrate. The test conditions will vary, depending on the type of washing appliance used and the habits of the user. Some users elect to use very hot water; others use warm or even cold water in laundering operations. Of course, the catalytic performance of the bleach catalyst will be affected by such considerations, and the levels of bleach catalyst used in fully-formulated detergent and bleach compositions can be appropriately adjusted. As a practical matter, and not by way of limitation, the compositions and processes herein can be adjusted to provide on the order of at least one part per ten million of the active bleach catalyst species in the aqueous washing liquor, and will preferably provide from about 0.2 ppm to about 200 ppm, preferably 0.4 ppm to 100 ppm of the catalyst species in the wash liquor. To illustrate this point further, on the order of 3 micromolar manganese catalyst is effective at 40° C., pH 10 under European conditions using perborate and a bleach precursor. An increase in concentration of 3–5 fold may be required under U.S. conditions to achieve the same results.

Surfactant

The detergent compositions in accord with the invention preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The detergent compositions in accord with the present invention preferably comprise an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/ or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_20)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20 % and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/ propoxylated fatty alcohols, nonionic ethoxylate/ propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolvsaccharide Surfactant

Suitable alkylpolysaccharides for use herein are disclosed in U.S. Pat. No. 4,565,647, Lienado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolygiycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$–$C_{18}$ acylamido alkyl dimethylamine oxide.

A suitable example of an alkyl aphodicarboxylic acid is Miranol(™) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary marines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO$— wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12\text{-}18}$ dimethylammonio hexanoate and the $C_{10\text{-}18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

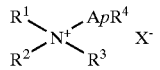

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2OH$, $—CH_2CH_2CH_2OH$, $—CH_2CH(CH_3)OH$ and $—CH(CH_3)CH_2OH$, with $—CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

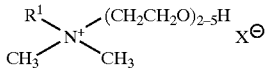

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic bis-Alkoxylated Amine Surfactant

The cationic bis-alkoxylated amine surfactant preferably has the general formula II:

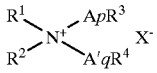

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., $—CH_2CH_2O—$), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

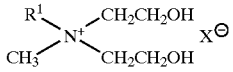

wherein $R^1$ is $C_{10}$–$C_{18}$ hydrocarbyl and mixtures thereof, preferably $C_{10}$, $C_{12}$, $C_{14}$ alkyl and mixtures thereof X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

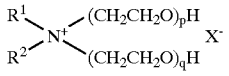

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide., Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Water-Soluble Builder Compound

The detergent compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent compositions of the invention preferably comprise phosphate-containing builder material. Preferably present at a level of from 0.5% to 60%, more preferably from 5% to 50%, more preferably from 8% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The detergent compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates.

Suitable aluminosilicate zeolites have the unit cell formula $Na_z[(AlO_2)_z(SiO_2)_y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof Zeolite A has the formula:

$$Na_{12}[AlO_2)_{12}(SiO_2)_{12}]. xH_2O$$

wherein x is from 20 to 30, especially 27. Zeolite X has the formula $Na_{86}$ $[(AlO_2)_{86}(SiO_2)_{106}]$. 276 $H_2O$.

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Heavy Metal Ion Sequestrant

The compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS), 1,1 hydroxyethane diphosphonic acid and 1,1 hydroxyethane dimethylene phosphonic acid or the alkali metal, alkaline earth metal, ammonium, or substituted ammonium salts thereof, or mixtures thereof.

Enzyme

Another preferred ingredient useful in the detergent compositions is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, a-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/ US 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Organic Polvmeric Compound

Organic polymeric compounds are preferred additional components of the detergent compositions and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoarnines and diamines of the formula:

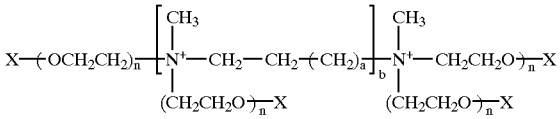

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polvmeric Dye Transfer Inhibiting Agents

The detergent compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The detergent compositions herein also optionally contain from about 0.005% to 5% by weight of certain types of hydrophilic optical brighteners.

Hydrophilic optical brighteners useful herein include those having the structural formula:

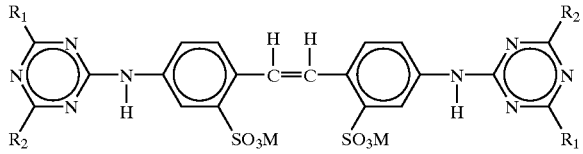

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Polymeric Soil Release Agent

Known polymeric soil release agents, hereinafter "SRA", can optionally be employed in the present detergent compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully- anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's usefil in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_{11}$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the compositions of the invention include perfumes, colours and filler salts, with sodium sulfate being a preferred filler salt.

Highly preferred may be the inclusion of speckle particles. The following speckle particle is a preferred speckle particle: Sodium carbonate particles, having 75% of particles having a particle size of from 600 microns to 850 microns and 25% of particles having a particle size of from 425 microns to 600 microns are obtained by agglomerating and sieving sodium carbonate powder. The thus obtained particles are sprayed with a Monastral blue BV paste solution and subsequently dried, obtaining speckle particles comprising about 1000 of dye.

Highly preferred compositions contain from about 2% to about 10% by weight of an organic acid, Preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

Form of the Compositions

The detergent composition of the invention can be made via a variety of methods, including dry-mixing and agglomerating and/or spray-drying of the various compounds comprised in the detergent component.

The compositions in accordance with the invention can take a variety of physical forms including liquid and solid forms such as tablet, flake, pastille and bar, and preferably granular forms.

The compositions in accord with the present invention can also be used in or in combination with bleach additive compositions, for example comprising chlorine bleach.

Chlorine-Based Bleach

The detergent compositions can include as an additional component a chlorine-based bleach. However, since preferred detergent compositions of the invention are solid, most liquid chlorine-based bleaching will not be suitable for these detergent compositions and only granular or powder chlorine-based bleaches will be suitable.

Alternatively, the detergent compositions can be formulated such that they are chlorine-based bleach-compatible, thus ensuring that a chlorine based bleach can be added to the detergent composition by the user at the beginning or during the washing process.

The chlorine-based bleachis such that a hypochlorite species is formed in aqueous solution. The hypochlorite ion is chemically represented by the formula $OC^-$.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

The mean particle size of the components of the granular compositions in accordance with the invention, should preferably be such that no more that 25% of the particles are greater than 1.8 mm in diameter and not more than 25% of the particles are less than 0.25 mm in diameter. Preferably the mean particle size is such that from 10% to 50% of the particles has a particle size of from 0.2 mm to 0.7 mm in diameter.

The term mean particle size as defined herein is calculated by sieving a sample of the composition into a number of fractions (typically 5 fractions) on a series of sieves, preferably Tyler sieves. The weight fractions thereby obtained are plotted against the aperture size of the sieves. The mean particle size is taken to be the aperture size through which 50% by weight of the sample would pass.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods.

In a preferred use aspect the detergent composition is formulated such that it is suitable for hand washing.

In another preferred aspect the detergent composition is a pre-treatment or soaking composition, to be used to pre-treat or soak soiled and stained fabrics.

Abbreviations used in Examples

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$—$C_{1y}$ alkyl sulfate |
| C46SAS | Sodium $C_{14}$—$C_{16}$ secondary (2,3) alkyl sulfate |
| CxyEzS | Sodium $C_{1x}$—$C_{1y}$ alkyl sulfate condensed with z moles of ethylene oxide |
| CxyEz | $C_{1x}$—$C_{1y}$ predominantly linear primary alcohol condensed with an average of z moles of ethylene oxide |
| QAS | $R_2.N^+(CH_3)_2(C_2H_4OH)$ with $R_2 = C_{12}$—$C_{14}$ |
| QAS 1 | $R_2.N^+(CH_3)_2(C_2H_4OH)$ with $R_2 = C_8$—$C_{11}$ |
| SADS | Sodium $C_{14}$—$C_{22}$ alkyl disulfate of formula 2-(R).$C_4H_7$.-1,4-$(SO_{4-})_2$ where R = $C_{10}$—$C_{18}$ |
| SADE2S | Sodium $C_{14}$—$C_{22}$ alkyl disulfate of formula 2-(R).$C_4H_7$.-1,4-$(SO_{4-})_2$ where R = $C_{10}$–$C_{18}$, condensed with z moles of ethylene oxide |
| MES | x-sulpho methylester of $C_{18}$ fatty acid |
| APA | $C_8$—$C_{10}$ amido propyl dimethyl amine |
| Soap | Sodium linear alkyl carboxylate derived from an 80/20 mixture of tallow and coconut fatty acids |
| STS | Sodium toluene sulphonate |

-continued

| | |
|---|---|
| CFAA | $C_{12}$—$C_{14}$ (coco) alkyl N-methyl glucamide |
| TFAA | $C_{16}$—$C_{18}$ alkyl N-methyl glucamide |
| TPKFA | $C_{16}$—$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 | Crystalline layered silicate of formula δ-$Na_2Si_2O_5$ |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/US9703635 |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photoactivated | Sulfonated zinc phthlocyanine encapsulated in bleach (1) dextrin soluble polymer |

-continued

| | |
|---|---|
| Photoactivated | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| HEDMP | 1,1-hydroxyethane dimethylene phosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis(($C_2H_5O$)($C_2H_4O$)$_n$)($CH_3$) -$N^+$—$C_6H_{12}$—$N^+$—($CH_3$) bis(($C_2H_5O$)-($C_2H_4O$))$_n$, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |
| Speckle particle | speckle particle as described herein on p. 40 |

In the following examples all levels are quoted as % by weight of the composition:

EXAMPLE 1

The following detergent formulations are in accord with the invention.

| | A | B | C | D |
|---|---|---|---|---|
| Blown powder | | | | |
| MES | 2.0 | 0.5 | 1.0 | — |
| SADS | — | — | — | 2.0 |
| LAS | 6.0 | 5.0 | 11.0 | 6.0 |
| TAS | 2.0 | — | — | 2.0 |
| Zeolite A | 24.0 | — | — | 20.0 |
| STPP | — | 27.0 | 24.0 | — |
| Sulfate | 4.0 | 6.0 | 13.0 | — |
| MA/AA | 1.0 | 4.0 | 6.0 | 2.0 |
| Silicate | 1.0 | 7.0 | 3.0 | 3.0 |
| CMC | 1.0 | 1.0 | 0.5 | 0.6 |
| Brightener 1 | 0.2 | 0.2 | 0.2 | 0.2 |
| Silicone antifoam | 1.0 | 1.0 | 1.0 | 0.3 |
| DTPMP | 0.4 | 0.4 | 0.2 | 0.4 |
| Spray on | | | | |
| Brightener | 0.02 | — | — | 0.02 |
| C45E7 | — | — | — | 5.0 |
| C45E2 | 2.5 | 2.5 | 2.0 | — |
| C45E3 | 2.6 | 2.5 | 2.0 | — |
| Perfume | 0.5 | 0.3 | 0.5 | 0.2 |
| Silicone antifoam | 0.3 | 0.3 | 0.3 | — |

-continued

| | A | B | C | D |
|---|---|---|---|---|
| Dry additives | | | | |
| QEA | — | — | — | 1.0 |
| EDDS | 0.3 | — | — | — |
| Sulfate | 2.0 | 3.0 | 5.0 | 10.0 |
| Carbonate | 6.0 | 13.0 | 15.0 | 14.0 |
| Citric acid | 2.5 | — | — | 2.0 |
| QAS II | 0.5 | — | — | 0.5 |
| SKS-6 | 10.0 | — | — | — |
| Percarbonate | 4.0 | 3.0 | — | 1.9 |
| PB4 | — | — | 5.0 | 10.0 |
| NOBS | 0.5 | — | — | 0.3 |
| TAED | 0.75 | 0.5 | 0.2 | 0.5 |
| DOBS | — | 0.5 | 0.6 | — |
| Protease | 1.0 | 1.0 | 1.0 | 1.0 |
| Lipase | — | 0.4 | — | 0.2 |
| Lipase(1) | 0.4 | — | 0.4 | — |
| Amylase | 0.2 | 0.2 | 0.2 | 0.4 |
| Brightener 1 | 0.05 | — | — | 0.05 |
| Misc/minor to 100% | | | | |

EXAMPLE 2

The following granular detergent formulations are in accord with the invention.

| | E | F | G | H | I | J |
|---|---|---|---|---|---|---|
| Blown powder | | | | | | |
| LAS | 23.0 | 8.0 | 7.0 | 9.0 | 7.0 | 7.0 |
| QAS | — | — | — | — | 1.0 | — |
| C45AS | 6.0 | 6.0 | 5.0 | 8.0 | — | — |
| C45AE11S | — | 1.0 | 1.0 | 1.0 | — | — |
| MES | 2.0 | — | — | — | 2.0 | 4.0 |
| Zeolite A | 10.0 | 18.0 | 14.0 | 12.0 | 10.0 | 10.0 |
| MA/AA | — | 0.5 | — | — | — | 2.0 |
| MA/AA (1) | 7.0 | — | — | — | — | — |
| AA | — | 3.0 | 3.0 | 2.0 | 3.0 | 3.0 |
| Sulfate | 5.0 | 6.3 | 11.1 | 11.0 | 11.0 | 18.1 |
| Silicate 10.0 | 1.0 | 1.0 | 1.0 | 1.0 | 1.0 | |
| Carbonate | 15.0 | 20.0 | 10.0 | 20.7 | 8.0 | 6.0 |
| PEG 4000 | 0.4 | 1.5 | 1.5 | 1.0 | 1.0 | 1.0 |
| DTPA | — | 0.9 | 0.5 | — | — | 0.5 |
| Brightener 2 | 0.3 | 0.2 | 0.3 | — | 0.1 | 0.3 |
| Spray on | | | | | | |
| C45E7 | — | 2.0 | — | — | 2.0 | 2.0 |
| C25E9 | 3.0 | — | — | — | — | — |
| C23E9 | — | — | 1.5 | 2.0 | — | 2.0 |
| Perfume 0.3 | 0.3 | 0.3 | 2.0 | 0.3 | 0.3 | |
| Agglomerates | | | | | | |
| C45AS | — | 5.0 | 5.0 | 2.0 | — | 5.0 |
| LAS | — | 2.0 | 2.0 | — | — | 2.0 |
| Zeolite A | — | 7.5 | 7.5 | 8.0 | — | 7.5 |
| Carbonate | — | 4.0 | 4.0 | 5.0 | — | 4.0 |
| PEG 4000 | — | 0.5 | 0.5 | — | — | 0.5 |
| Misc (water etc) | — | 2.0 | 2.0 | 2.0 | — | 2.0 |
| Dry additives | | | | | | |
| QAS (I) | — | — | — | — | 1.0 | — |
| Citric acid | — | — | — | — | 2.0 | — |
| PB4 | — | 3.0 | — | — | 5 | — |
| PB1 | — | — | 4 | 1.0 | — | — |
| Percarbonate | 2.0 | — | — | 1.0 | — | 2.0 |
| Carbonate | — | 5.3 | 1.8 | — | 4.0 | 4.0 |
| NOBS | 0.5 | — | 0.4 | 0.3 | — | 0.6 |
| DOBS | — | 0.9 | — | — | 0.3 | — |
| TAED | 0.6 | 0.4 | 0.6 | 0.3 | 0.9 | 0.5 |
| Methyl cellulose | 0.2 | — | — | — | — | 0.5 |
| DTPA | 0.7 | 0.5 | 1.0 | 0.5 | 0.5 | 1.2 |

-continued

| | E | F | G | H | I | J |
|---|---|---|---|---|---|---|
| SKS-6 | 8.0 | — | — | — | — | — |
| STS | — | — | 2.0 | — | 1.0 | — |
| Cumene sulfonic acid | — | 1.0 | — | — | — | 2.0 |
| Lipase | 0.2 | — | 0.2 | — | 0.2 | 0.4 |
| Cellulase | 0.2 | 0.2 | 0.2 | 0.3 | 0.2 | 0.2 |
| Amylase II | 0.2 | — | 0.1 | — | 0.2 | — |
| Protease | 0.5 | 0.5 | 0.5 | 0.3 | 0.5 | 0.5 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP1 | 0.2 | 0.5 | 0.3 | — | 0.2 | — |
| Silicone antifoam | 0.2 | 0.4 | 0.2 | 0.4 | 0.1 | — |
| Mg sulfate | — | — | 0.2 | — | 0.2 | — |
| speckle | — | 2.0 | 1.0 | 0.5 | 2.0 | 6.0 |
| Misc/minors to 100% | | | | | | |

EXAMPLE 3

The following granular detergent formulations are in accord with the invention.

| | K | L | M | N |
|---|---|---|---|---|
| Base granule | | | | |
| STPP | — | 22.0 | — | 15.0 |
| Zeolite A | 30.0 | — | 24.0 | 5.0 |
| Sulfate | 5.5 | 5.0 | 7.0 | 7.0 |
| MA/AA | 3.0 | — | — | — |
| AA | — | 1.6 | 2.0 | — |
| MA/AA (1) | — | 12.0 | — | 6.0 |
| LAS | 14.0 | 10.0 | 9.0 | 20.0 |
| C45AS | 8.0 | 7.0 | 9.0 | 7.0 |
| C45AE11S | — | 1.0 | — | 1.0 |
| MES | 0.5 | 4.0 | 6.0 | — |
| SADS | 2.5 | — | — | 1.0 |
| Silicate | — | 1.0 | 0.5 | 10.0 |
| Soap | — | 2.0 | — | — |
| Brightener 1 | 0.2 | 0.2 | 0.2 | 0.2 |
| Carbonate | 6.0 | 9.0 | 8.0 | 10.0 |
| PEG 4000 | — | 1.0 | 1.5 | — |
| DTPA | — | 0.4 | — | — |
| Spray on | | | | |
| C25E9 | — | — | — | 5.0 |
| C45E7 | 1.0 | 1.0 | — | — |
| C23E9 | — | 1.0 | 2.5 | — |
| Perfume | 0.2 | 0.3 | 0.3 | — |
| Dry additives | | | | |
| Carbonate | 5.0 | 10.0 | 13.0 | 8.0 |
| PVPVI/PVNO | 0.5 | — | 0.3 | — |
| Protease | 1.o | 1.0 | 1.0 | 0.5 |
| Lipase | 0.4 | — | — | 0.4 |
| Amylase | 0.1 | — | — | 0.1 |
| Cellulase | 0.1 | 0.2 | 0.2 | 0.1 |
| DTPA/HEDP | 0.5 | 0.3 | 0.5 | 1.0 |
| LOBS | — | 0.8 | — | 0.3 |
| PB1 | 5 | 3.0 | 10 | 4.0 |
| DOBA | 1.0 | — | 0.4 | — |
| TAED | 0.5 | 0.3 | 0.5 | 0.6 |
| Sulfate | 4.0 | 5.0 | — | 5.0 |
| SRPJ | — | 0.4 | — | — |
| Sud supressor | — | 0.5 | — | — |
| Speckle | 1.0 | 0.5 | — | 5.0 |
| Misc/minor to 100% | | | | |

EXAMPLE 4

The following compositions are pre-treatment compositions in accordance with the invention

| | O | P | Q | R | S | T | U |
|---|---|---|---|---|---|---|---|
| MES | 1.0 | 2.0 | 0.8 | 4.0 | — | — | — |
| C45E7 | 6.5 | 7.5 | — | — | — | — | — |
| C23E3 | — | 2.0 | 5.0 | 5.0 | 7.0 | 9.0 | 3.0 |
| C25E2.5S | 10.0 | 14.0 | 17.0 | 8.0 | 5.0 | 15.0 | 20.0 |
| SADS | — | — | 3.0 | — | 1.0 | 1.0 | 2.0 |
| Acetyltriethyl citrate | 3.5 | 4.0 | 2.5 | — | — | 3.0 | 3.5 |
| Percarbonate | — | — | 3.0 | 2.0 | 3.0 | — | — |
| Perborate | 2.0 | 3.0 | — | — | — | 1.0 | 5.0 |
| NACA-OBS | | 0.3 | — | — | — | 0.6 | 0.4 |
| NOBS/LOBS/DOBS | 1.0 | — | 1.0 | 0.2 | 0.4 | — | — |
| TAED | 0.5 | 0.6 | 0.3 | 0.8 | 0.9 | 0.4 | 0.7 |
| Chelant | 0.3 | 0.5 | — | — | 0.2 | — | 0.8 |
| Water and minors $H_2SO_4$ up to pH 4 | | | | | | | |

EXAMPLE 5

| | V | W | X | Y | Z | AA | BB |
|---|---|---|---|---|---|---|---|
| Sodium $C_{11}$–$C_{13}$ alkylbenzenesulfonate | 12.0 | 16.0 | 23.0 | 19 | 18.0 | 20.0 | 16.0 |
| Sodium $C_{14}$–$C_{15}$ alcohol sulfate | | 4.5 | — | | — | — | 4.0 |
| $C_{14}$–$C_{15}$ alcohol ethoxylate (0.5) sulfate | | | — | — | — | — | — |
| $C_{14}$–$C_{15}$ alcohol ethoxylate (3) sulfate | — | — | 2.0 | — | 1.0 | 1.0 | 1.0 |
| Sodium $C_{14}$–$C_{15}$ alcohol ethoxylate (3.0) | 2.0 | 2.0 | — | 1.3 | — | — | 0.6 |
| $C_9$–$C_{14}$ alkyl dimethyl hydroxy ethyl quaternary ammonium salt | | | — | — | 1.0 | 0.5 | 2.0 |
| Tallow fatty acid | | | — | — | — | — | 1.0 |
| Tallow alcohol ethoxylate (50) | — | — | — | — | — | — | — |
| Sodium tripolyphosphate | 23.0 | 25.0 | 24.0 | 22.0 | 20.0 | 15.0 | 20.0 |
| Sodium carbonate | 15.0 | 12.0 | 15.0 | 10.0 | 13.0 | 11.0 | 10.0 |
| Sodium Polyacrylate (45%) | 0.5 | 0.5 | 0.5 | 0.5 | — | — | — |
| Sodium polyacrylate/maleate polymer | — | — | 1.0 | 1.0 | 1.0 | 2.0 | 0.5 |
| Sodium silicate (1:6 ratio $NaO/SiO_2$) (46%) | 3.0 | 6.0 | 9.0 | 8.0 | 9.0 | 6.0 | 8.0 |
| Sodium sulfate | 25.0 | 18.0 | 20.0 | 18.0 | 20.0 | 22.0 | 13.0 |
| Sodium perborate | 5.0 | 5.0 | 10.0 | 8.0 | 3.0 | 1.0 | 2.0 |
| Poly(ethyleneglycol), MW ~4000 (50%) | 1.5 | 1.5 | 1.0 | 1.0 | — | — | 0.5 |
| Sodium carboxy methyl cellulose | 1.0 | 1.0 | 1.0 | — | 0.5 | 0.5 | 0.5 |
| Citric acid | — | — | — | — | — | — | — |
| NOBS/DOBS | 0.5 | 1.0 | 0.5 | 0.5 | 1.0 | 0.7 | 0.3 |
| TAED | 1.5 | 1.0 | 2.5 | 3.0 | 0.3 | 0.2 | 0.5 |
| Soil release polymer[1] | 1.5 | 1.5 | 1.0 | 1.0 | — | 1.0 | — |
| Soil release polymer[2] | — | — | — | — | 1.0 | — | 1.0 |
| Moisture | 7.5 | 7.5 | 6.0 | 7.0 | 5.0 | 3.0 | 5.0 |
| Magnesium sulphate | — | — | — | — | 1.0 | 0.5 | 1.5 |
| Speckle | 0.5 | 3.0 | — | 5.0 | 2.0 | — | 0.2 |
| Chelants | — | — | — | — | 0.8 | 0.6 | 1.0 |
| Enzymes, including amylase, amylase II, cellulase, protease and lipase | — | — | — | — | 2.0 | 1.5 | 2.0 |
| minors, e.g. perfume, brightener, photobleach, dye | 1.0 | 1.0 | 1.0 | 1.0 | 0.5 | 1.5 | 1.0 |

[1]Non-cotton soil release polymer according to U.S. Pat. No. 5,415,807, Gosselink, Pan, Kellett and Hall, issued May 16, 1995.
[2]Non-cotton soil release polymer according to U.S. application Ser. No. 60/051517

EXAMPLE 6

| | CC | DD | EE | FF |
|---|---|---|---|---|
| Sodium $C_{11}$—$C_{13}$ alkylbenzenesulfonate | 13.3 | 13.7 | 10.4 | 8.0 |
| Sodium $C_{14}$—$C_{15}$ alcohol sulfate | 3.9 | 4.0 | 4.5 | — |
| $C_{14}$—$C_{15}$ alcohol ethoxylate (0.5) sulfate | 2.0 | 2.0 | — | — |
| $C_{14}$—$C_{15}$ alcohol ethoxylate (3) sulfate | — | — | — | — |
| Sodium $C_{14}$—$C_{15}$ alcohol ethoxylate (6.5) | 0.5 | 0.5 | 0.5 | 5.0 |
| $C_9$—$C_{14}$ alkyl dimethyl hydroxy ethyl quaternary ammonium salt | 1.0 | — | — | 0.5 |
| Tallow fatty acid | 0.5 | — | — | — |
| Tallow alcohol ethoxylate (50) | — | — | 1.0 | 0.3 |
| Sodium tripolyphosphate | — | 41.0 | — | 20.0 |
| Zeolite A, hydrate (0.1–10 micron size) | 26.3 | — | 21.3 | 1.0 |
| Sodium carbonate | 23.9 | 12.4 | 25.2 | 17.0 |
| Sodium Polyacrylate (45%) | 3.4 | 0.0 | 2.7 | — |
| Sodium polyacrylate/maleate polymer | — | — | 1.0 | 1.5 |
| Sodium silicate (1:6 ratio $NaO/SiO_2$)(46%) | 2.4 | 6.4 | 2.1 | 6.0 |
| Sodium sulfate | 10.5 | 10.9 | 8.2 | 15.0 |
| Sodium perborate | 1.0 | 1.0 | 1.0 | 2.0 |
| Poly(ethyleneglycol), MW ~4000 (50%) | 1.7 | 0.4 | 1.0 | — |
| Sodium carboxy methyl cellulose | 1.0 | — | — | 0.3 |
| Citric acid | — | — | 3.0 | — |
| NOBS/DOBS | 0.2 | 0.5 | 0.5 | 0.1 |
| TAED | 0.6 | 0.5 | 0.4 | 0.3 |
| Soil release polymer[1] | 1.5 | — | — | — |
| Soil release polymer[2] | — | 1.5 | 1.0 | 1.0 |
| Moisture | 7.5 | 3.1 | 6.1 | 7.3 |
| Magnesium sulphate | — | — | — | 1.0 |
| Chelants | — | — | — | 0.5 |
| Enzymes, including amylase, amylase II, cellulase, protease and lipase | — | 1.0 | — | 1.5 |
| minors, e.g. perfume, brightener, photo-bleach, dye | 1.0 | 1.0 | 1.0 | 1.0 |

[1]Non-cotton soil release polymer according to U.S. Pat. 4,968,451, Scheibel et al, issued Nov. 6, 1990.
[2]Non-cotton soil release polymer according to U.S. application no. 60/051517

What is claimed is:

1. A detergent composition, having a density of from 330 g/liter to 700 g/liter, comprising a bleaching system containing a hydrophilic and a hydrophobic peracid bleach or precursors thereto and a peroxide source, characterized in that the total level of Available Oxygen from the hydrophilic and hydrophobic peracid bleach (AvO-a) is less than 5000 ppm by weight of the composition, the ratio of Available Oxygen of the hydrophobic peracid or precursor (AvO-hb) to the Available Oxygen of the hydrophilic peracid or precursor (AvO-hp) is from 3:1 to 1:50 and the ratio of the Available Oxygen of the peroxide source (AvO-o) to the AvO-a is at least 2:1.

2. A detergent composition according to claim 1 wherein the hydrophilic bleach precursor comprises TAED.

3. A detergent composition according to claim 2 wherein the hydrophobic peracid or precursor comprises a hydrophobic group which is derived from fatty acid comprising at least 8 carbon atoms.

4. A detergent composition according to claim 1 wherein the ratio of AvO-o to the AvO-a is at least 3:1.

5. A detergent composition according to claim 1, comprising a phosphate-builder.

6. A detergent composition according to claim 1 whereby the peroxide source bleaching comprises one or more inorganic perhydrate salts.

7. A detergent composition according to claim 1 comprising one or more enzyme.

8. Method for sanitization of fabrics comprising the step of contacting the fabrics with a composition or a solution of a composition, comprising a hydrophilic and hydrophobic peracid bleach or precursors and a peroxide source, characterized in that the ratio of Available Oxygen of the hydrophobic peracid or precursor (AvO-hb) to the Available Oxygen of the hydrophilic peracid or precursor (AvO-hp) is from 3:1 to 1:50 and the ratio of the Available Oxygen of the peroxide source (AvO-o) to the total level of Available Oxygen from the hydrophilic and hydrophobic peracid bleach (AvO-a) is at least 2:1.

9. A detergent composition according to claim 4 wherein the ratio of AvO-o to the AvO-a is at least 4:1.

10. A detergent composition according to claim 2 wherein the hydrophobic peracid or precursor comprises a peracid precursor having a oxybenzene sulfonate leaving group.

* * * * *